US008410888B2

(12) United States Patent
Weber

(10) Patent No.: US 8,410,888 B2
(45) Date of Patent: Apr. 2, 2013

(54) METHOD FOR PRODUCING A DISK WINDING AND DISK WINDING

(75) Inventor: Benjamin Weber, Winterberg (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/295,353

(22) Filed: Nov. 14, 2011

(65) Prior Publication Data

US 2012/0119870 A1 May 17, 2012

Related U.S. Application Data

(63) Continuation of application No. PCT/EP2010/002591, filed on Apr. 28, 2010.

(30) Foreign Application Priority Data

May 14, 2009 (EP) ..... 09006511

(51) Int. Cl.
*H01F 27/30* (2006.01)
*H01F 27/28* (2006.01)
*H01F 7/06* (2006.01)

(52) U.S. Cl. ..... 336/207; 336/222; 29/602.1

(58) Field of Classification Search ..... 336/199, 336/206, 207, 222, 223, 180, 185, 187; 29/602.1, 29/603.23, 603.24
See application file for complete search history.

(56) References Cited

U.S. PATENT DOCUMENTS 2,368,506 A * 1/1945 Paluev ..... 336/60
2,977,556 A * 3/1961 Gray et al. ..... 336/185
3,188,591 A * 6/1965 Dortort et al. ..... 336/185
3,246,270 A * 4/1966 Stein ..... 336/70
3,327,266 A 6/1967 Dierick
3,419,835 A 12/1968 Stein
3,546,644 A * 12/1970 Michel et al. ..... 336/223
3,548,355 A * 12/1970 Miller et al. ..... 336/60
3,691,494 A * 9/1972 Okuyama ..... 336/70
4,137,515 A * 1/1979 Akao et al. ..... 336/84 C
4,476,393 A * 10/1984 Taya et al. ..... 250/492.2
4,761,628 A * 8/1988 Nishi et al. ..... 336/180
5,455,551 A * 10/1995 Grimes et al. ..... 336/60
(Continued)

FOREIGN PATENT DOCUMENTS

DE 2051806 A1 4/1972
EP 1315183 A2 5/2003
GB 1071469 A 6/1967
GB 1217703 A 12/1970

OTHER PUBLICATIONS

International Search Report (PCT/ISA/210) issued on Nov. 25, 2010, by European Patent Office as the International Searching Authority for International Application No. PCT/EP2010/002591.

*Primary Examiner* — Mohamad Musleh
*Assistant Examiner* — Joselito Baisa
(74) *Attorney, Agent, or Firm* — Buchanan Ingersoll & Rooney PC

(57) ABSTRACT

An method for producing a disk winding having disks arranged alongside one another, includes winding the disk winding and fitting intermediate insulation between adjacent disks simultaneously, and subdividing the insulation into two sub-areas with a connecting conductor that runs from an end of one disk to a start of an adjacent disk along a diagonal within the intermediate insulation. The sub-areas can include a first intermediate area with a triangular cross-section formed below this diagonal and a second intermediate area which has an opposite triangular cross-section and formed above this diagonal.

8 Claims, 2 Drawing Sheets

U.S. PATENT DOCUMENTS 7,318,270 B1 * 1/2008 O'Loughlin ..... 29/605
7,719,397 B2 * 5/2010 Pauley et al. ..... 336/55
7,724,120 B2 * 5/2010 Hahn et al. ..... 336/234
2003/0156004 A1 8/2003 Weber et al.

* cited by examiner

METHOD FOR PRODUCING A DISK WINDING AND DISK WINDING

RELATED APPLICATION(S)

This application claims priority as a continuation application under 35 U.S.C. §120 to PCT/EP2010/002591, which was filed as an International Application on Apr. 28, 2010 designating the U.S., and which claims priority to European Application 09006511.1 filed in Europe on May 14, 2009. The entire contents of these applications are hereby incorporated by reference in their entireties.

FIELD

The disclosure relates to a method for producing a disk winding, for example, for high-voltage windings of dry-type transformers.

BACKGROUND INFORMATION

Disk windings can be used in the field of high-voltage coils produced using a vacuum encapsulation technique. In this case, a conductor ribbon having dimensions, for example, 20 mm wide and 0.2 mm thick can be wound together with a turn insulator, having dimensions, for example, 30 mm wide and 0.1 mm thick, onto one another to form a "disk," with a winding start being located close to the winding core. After 100 turns, for example, the disk can be ended, the conductor ribbon is folded through 90°, and can be passed down in a direction of a winding core to form a new disk. There, it is folded through 90° again, and a further disk is wound. A disk winding such as this can include a large number of such disks arranged adjacent to one another. After the disk winding has been completed, or a final disk is wound, it can be encapsulated using a vacuum encapsulation method.

SUMMARY

A method for producing a disk winding having at least three disks is disclosed arranged alongside one another, comprising: winding the disk winding in a winding process, fitting intermediate insulation between adjacent disks simultaneously with the winding within the winding process, and subdividing the intermediate insulation into two sub-areas with a connecting conductor that runs from an end of one disk to a start of an adjacent disk along a diagonal within the intermediate insulation, the sub-areas including a first intermediate insulation area which has a triangular cross-section and is formed below this diagonal and a second intermediate insulation area which has an opposite triangular cross-section and is formed above this diagonal, wherein, for a disk winding which progresses from left to right, insulation is fitted in the second intermediate insulation area to a left of the disk and insulation is fitted in the first intermediate insulation area to a right of the disk simultaneously with the winding of the disk, and wherein, for a disk winding which progresses from right to left, insulation is fitted in the second intermediate insulation area to the right of the disk and insulation is fitted in the first intermediate insulation area to the left of the disk simultaneously with the winding of the disk.

A disk winding is disclosed, comprising: at least three disks arranged alongside one another, intermediate insulation fitted between adjacent disks simultaneously with the winding within a winding process, and a connecting conductor that runs from an end of one disk to a start of an adjacent disk along a diagonal within the intermediate insulation subdividing the intermediate insulation into two sub-areas with the sub-areas including a first intermediate insulation area which has a triangular cross-section and is formed below this diagonal and a second intermediate insulation area which has an opposite triangular cross-section and is formed above this diagonal, wherein, for a disk winding which progresses from left to right, insulation is fitted in the second intermediate insulation area to a left of the disk and insulation is arranged in the first intermediate insulation area to a right of the disk simultaneously with the winding of the disk, and wherein, for a disk winding which progresses from right to left, insulation is fitted in the second intermediate insulation area to the right of the disk and insulation is fitted in the first intermediate insulation area to the left of the disk simultaneously with the winding of the disk.

BRIEF DESCRIPTION OF THE DRAWINGS

The disclosure will be explained in the following text with reference to the exemplary embodiments illustrated in the drawing, in which.

DETAILED DESCRIPTION

According to an exemplary embodiment of the disclosure, a method is disclosed for producing a disk winding having at least three disks arranged alongside one another. During manufacture, intermediate insulation can be fitted (i.e., arranged between, in each case, two disks simultaneously with the winding within a winding process. A connecting conductor runs from an end of one disk to a start of a further disk in the form of (i.e., along) a diagonal within the intermediate insulation, and thus subdivides the intermediate insulation into two sub-areas. The sub-areas include a first intermediate insulation area which has a triangular cross-section and is formed below this diagonal and a second intermediate insulation area which has an opposite triangular cross-section and is formed above this diagonal. In the case of a disk winding which progresses from left to right, insulation can be fitted in the second intermediate insulation area to the left of the disk and insulation can be fitted in the first intermediate insulation area to the right of the disk simultaneously with the winding of the disk. In the case of a disk winding which progresses from right to left, insulation can be fitted in the second intermediate insulation area to the right of the disk and insulation can be fitted in the first intermediate insulation area to the left of the disk simultaneously with the winding of the disk.

According to the disclosure, an exemplary profile of a connection of two disks to one another can be produced within one winding process without resulting in cavities. Cavities can be difficult to wind with insulation, such as resin roving. This can ensure good electrical characteristics for a high-voltage coil or transformer, with a compact, space-saving design.

The production of the intermediate insulation will be considered in more detail in the following text.

Figure 1:
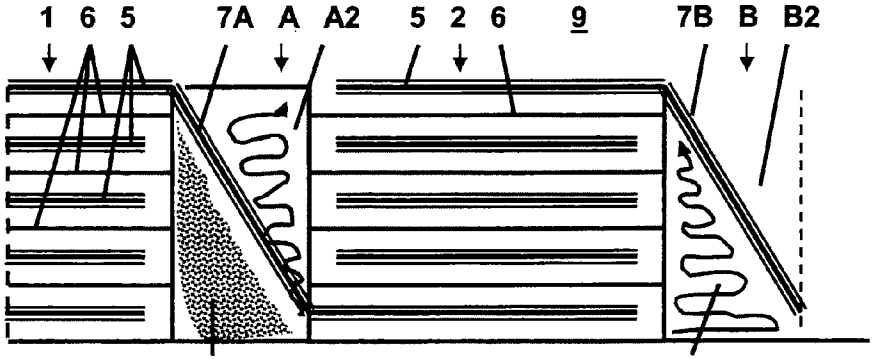
FIG. 1 shows a side section through a section of a disk winding while a manufacturing step according to an exemplary embodiment of the invention is being carried out for a disk winding which progresses from left to right.

In this context, FIG. 1 shows a side section through a section of a disk winding 9, which progresses from left to right, while a manufacturing step is being carried out. In FIG. 1, the first disk 1 has already been completed, while the second disk 2 is currently being wound. The intermediate insulation A is arranged between the disks 1, 2. Each disk can have (or intended to have) a predetermined number of turns which are composed of a conductor ribbon 5, with a turn insulator 6, which can also be in the form of a ribbon, being located between each two turns. The conductor ribbon 5 is continuous from an end of the first disk 1 to a start of the second disk 2, in the form of a connecting conductor 7A. Within the intermediate insulation cross-section, this connecting conductor 7A effectively corresponds to a diagonal of the intermediate insulation A, which subdivides the intermediate insulation A into two sub-areas. The sub-areas include a first intermediate insulation area A1 having a triangular cross-section, which is formed below this diagonal and in which insulation has already been applied in a previous manufacturing step while winding the first disk 1, and a second intermediate insulation area A2 with an opposite triangular cross-section, which is formed above this diagonal and in which insulation is applied simultaneously with the winding of the disk 2 during the manufacturing step that is being carried out. The meandering line profile depicts the application of the insulation.

Similar manufacturing measures can apply to the intermediate insulation B between the disk 2, which is wound during the manufacturing step that is being carried out in FIG. 1, and the disk 3, which is to be wound in a next manufacturing step. The cross-section of this intermediate insulation B can be subdivided in the same manner into two sub-areas by the connecting conductor 7B, which effectively corresponds to a diagonal of the intermediate insulation B. The sub-areas include a first intermediate insulation area B1 having a triangular cross-section, which is formed below this diagonal and in which insulation is applied simultaneously with the winding of the disk 2 during the manufacturing step that is being carried out in FIG. 1. The meandering line profile depicts the application of insulation into a second intermediate insulation area B2 having an opposite triangular cross-section, which is formed above this diagonal and in which insulation is not intended to be applied until a next manufacturing step while winding the next disk 3.

An exemplary embodiment of the disclosure provides for a winding of a disk to be produced together with two subareas of the intermediate insulation which is provided on both sides of the disk, for which purpose insulation is applied simultaneously, adjacent to the disk, with an opposite triangular cross-section on the one (for example left-hand) side and with a triangular cross-section on the other (for example right-hand) side during the winding of the conductor ribbon 5 and the turn insulator 6.

In an exemplary embodiment according to the disclosure, this insulation can include, for example, one or more glass rovings which can be impregnated with a resin. In an exemplary embodiment, a pre-impregnated material can also be used. For a method, such as a wet-winding method, it can be possible to ensure that the intermediate spaces between the conductor ribbon 5 and the turn insulator 6 are filled with a resin.

Figure 2:
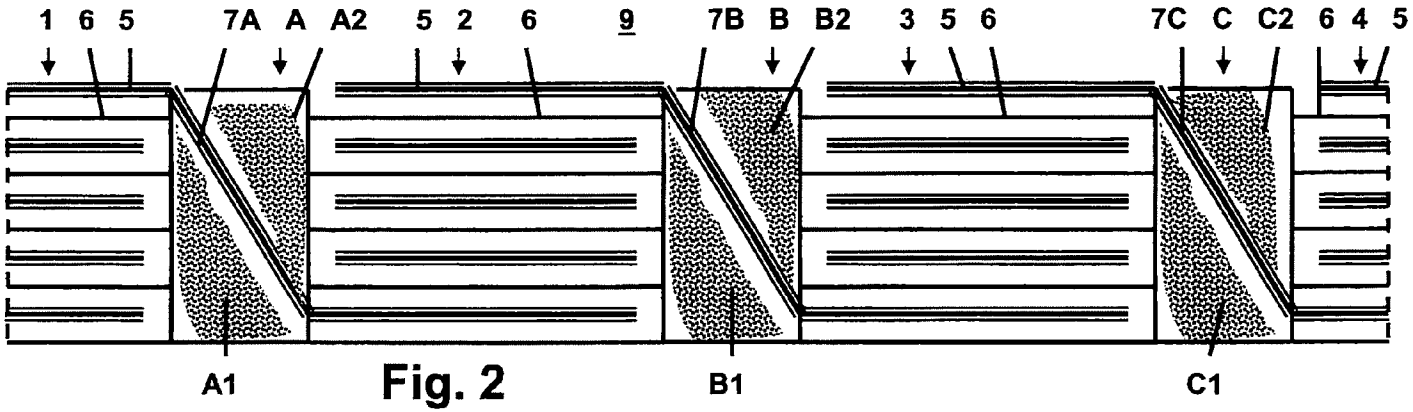
FIG. 2 shows a side section through a sub-area of a completed disk winding according to an exemplary embodiment of the invention.

FIG. 2 shows a side section through a subarea of a completed disk winding 9 according to an exemplary embodiment of the disclosure (a disk winding which progresses from left to right) including the first disk 1, formed from a desired number of turns of the conductor ribbon 5 and the turn insulator 6. The second disk 2 is formed from a desired number of turns of the conductor ribbon 5 and the turn insulator 6. The first intermediate insulation A between the disks 1 and 2 is subdivided into the first intermediate insulation area A1 with a triangular cross-section and into the second intermediate insulation area A2 with the opposite triangular cross-section. The connecting conductor 7A forms the diagonal boundary surface between the two intermediate insulation areas A1, A2. The third disk 3 is formed from a desired number of turns of the conductor ribbon 5 and the turn insulator 6. The second intermediate insulation B between the disks 2 and 3 is subdivided into the first intermediate insulation area B1 with a triangular cross-section and into the second intermediate insulation area B2 with the opposite triangular cross-section. The connecting conductor 7B forms the diagonal boundary surface between the two intermediate insulation areas B1, B2. The fourth disk 4 is formed from a desired number of turns of the conductor ribbon 5 and the turn insulator 6. The third intermediate insulation C between the disks 3 and 4 is subdivided into the first intermediate insulation area C1 with a triangular cross-section and into the second intermediate insulation area C2 with the opposite triangular cross-section. The connecting conductor 7C forms the diagonal boundary surface between the two intermediate insulation areas C1, C2.

The above explanatory notes are, of course, intended in their entirety to explain the intermediate insulation which is located between two disks, in the present case the intermediate insulation A, B, C. In contrast to this, in the case of the first disk 1, no intermediate insulation area with an opposite triangular cross-section is manufactured (for example to the left of the disk winding in the case of a disk winding which progresses from left to right). In the case of the last disk, in this case the disk 4, no intermediate insulation area with a triangular cross-section is likewise manufactured (for example to the right of the disk winding in the case of a disk winding which progresses from left to right).

Figure 3:
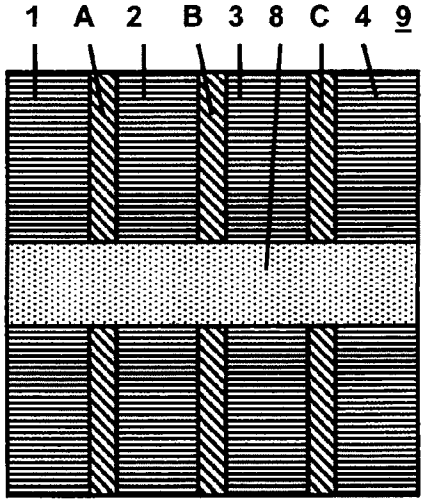
FIG. 3 shows a side section through a completed disk winding according to an exemplary embodiment of the invention.

FIG. 3 shows a side section through a completed disk winding according to an exemplary embodiment of the invention. The disk winding 9, which progresses from left to right and surrounds a winding core 8, has four disks, with intermediate insulation being provided between each of the individual disks of the disk winding 9. In this context, reference is also made to the initial explanatory notes, which can also be applicable to the disclosure. With respect to the intermediate insulation, this means, a first intermediate insulation A is arranged between a first disk 1 and a second disk 2, a second intermediate insulation B is arranged between the second disk 2 and a third disk 3, a third intermediate insulation C is arranged between the third disk 3 and a fourth disk 4.

Figure 4:
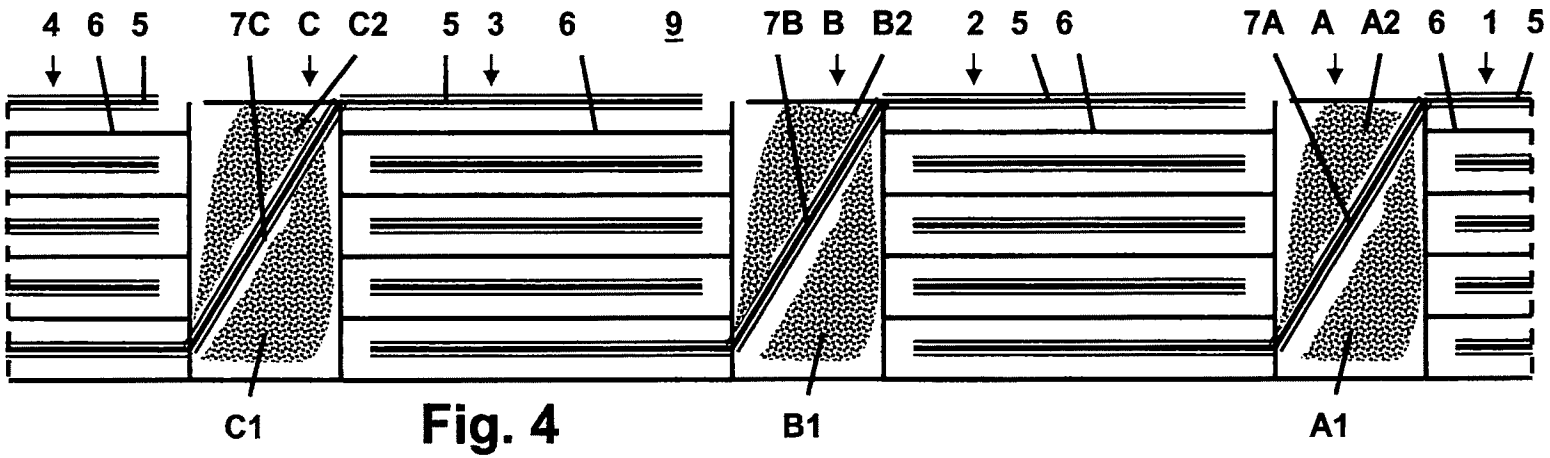
FIG. 4 shows a disk winding according to an exemplary embodiment of the invention which progresses from right to left.

The above explanatory notes also apply, of course, in their entirety to a disk winding which progresses from right to left, as is sketched in FIG. 4.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 First disk
2 Second disk
3 Third disk
4 Fourth disk
5 Conductor ribbon
6 Turn insulator
7 7A, 7B, 7C Connecting conductor
8 Winding core
9 Disk winding
A First intermediate insulation
A1 First intermediate insulation area (with a triangular cross-section)
A2 Second intermediate insulation area (with an opposite triangular cross-section)
B Second intermediate insulation
B1 First intermediate insulation area (with a triangular cross-section)
B2 Second intermediate insulation area (with an opposite triangular cross-section)
C Third intermediate insulation
C1 First intermediate insulation area (with a triangular cross-section)
C2 Second intermediate insulation area (with an opposite triangular cross-section)

What is claimed is:

1. A disk winding, comprising:

at least three disks arranged alongside one another;

intermediate insulation fitted between adjacent disks simultaneously with the winding within a winding process; and a connecting conductor that runs from an end of one disk to a start of an adjacent disk along a diagonal within the intermediate insulation subdividing the intermediate insulation into two sub-areas with the sub-areas including a first intermediate insulation area which has a triangular cross-section and is formed below this diagonal and a second intermediate insulation area which has an opposite triangular cross-section and is formed above this diagonal, wherein, for a disk winding which progresses from left to right, insulation is fitted in the second intermediate insulation area to a left of the disk and insulation is arranged in the first intermediate insulation area to a right of the disk simultaneously with the winding of the disk, and wherein, for a disk winding which progresses from right to left, insulation is fitted in the second intermediate insulation area to the right of the disk and insulation is fitted in the first intermediate insulation area to the left of the disk simultaneously with the winding of the disk.

2. The disk winding as claimed in claim 1, wherein, for a disk winding which progresses from left to right, no intermediate insulation area is arranged to the left of the first disk and, for a disk winding which progresses from right to left, no intermediate insulation area is arranged to the right of the first disk.

3. A method for producing a disk winding having at least three disks arranged alongside one another, the method comprising:

winding the disk winding in a winding process;

fitting intermediate insulation between adjacent disks simultaneously with the winding within the winding process; and subdividing the intermediate insulation into two sub-areas with a connecting conductor that runs from an end of one disk to a start of an adjacent disk along a diagonal within the intermediate insulation, the sub-areas including a first intermediate insulation area which has a triangular cross-section and is formed below this diagonal and a second intermediate insulation area which has an opposite triangular cross-section and is formed above this diagonal, wherein, for a disk winding which progresses from left to right, insulation is fitted in the second intermediate insulation area to a left of the disk and insulation is fitted in the first intermediate insulation area to a right of the disk simultaneously with the winding of the disk, and wherein, for a disk winding which progresses from right to left, insulation is fitted in the second intermediate insulation area to the right of the disk and insulation is fitted in the first intermediate insulation area to the left of the disk simultaneously with the winding of the disk.

4. The method as claimed in claim 3, wherein, for a disk winding which progresses from left to right, no intermediate insulation area is arranged to the left of the first disk and, for a disk winding which progresses from right to left, no intermediate insulation area is arranged to the right of the first disk.

5. The method as claimed in claim 3, wherein, for a disk winding which progresses from left to right, no intermediate insulation area is arranged to the right of the last disk and, for a disk winding which progresses from right to left, no intermediate insulation area is arranged to the left of the last disk.

6. The method as claimed in claim 3, comprising:

glass rovings impregnated with resin are used as insulation.

7. The disk winding as claimed in claim 3, wherein, for a disk winding which progresses from left to right, no intermediate insulation area is arranged to the right of a last disk and, for a disk winding which progresses from right to left, no intermediate insulation area is arranged to the left of a last disk.

8. The disk winding as claimed in claim 3, comprising:

glass rovings impregnated with resin as the intermediate insulation.

* * * * *